United States Patent [19]

Brickman

[11] Patent Number: 4,603,642

[45] Date of Patent: Aug. 5, 1986

[54] FOLDABLE TABLE HAVING STORAGE CAPABILITIES

[76] Inventor: Harold Brickman, 2911 W. Catalpa, Chicago, Ill. 60625

[21] Appl. No.: 676,496

[22] Filed: Nov. 29, 1984

[51] Int. Cl.[4] ..... A47B 85/00

[52] U.S. Cl. ..... 108/25; 108/11

[58] Field of Search ..... 108/25, 11, 118

[56] References Cited

U.S. PATENT DOCUMENTS 2,363,699 11/1944 Smith ..... 108/25 X
3,166,028 1/1965 Zagel ..... 108/25
3,233,940 2/1966 Tooley, Jr. ..... 108/25 X
3,693,555 9/1972 Holtzmann ..... 108/25
4,122,780 10/1978 Brickman ..... 108/25
4,177,737 12/1979 Brickman ..... 108/25 X

*Primary Examiner*—William E. Lyddane
*Assistant Examiner*—José V. Chen
*Attorney, Agent, or Firm*—McDougall, Hersh & Scott

[57] ABSTRACT

A foldable table has a flexible panel provided with openings. Attached to the flexible panel and extending below the openings are open grid-like receptacles for receiving articles intended for beverage consumption.

5 Claims, 4 Drawing Figures

FOLDABLE TABLE HAVING STORAGE CAPABILITIES

BACKGROUND OF THE INVENTION

This invention relates generally to foldable tables. More specifically, it relates to improvements in such tables utilizing lightweight containers for holding articles intended for beverage consumption for use and storage purposes.

In the copending applications Ser. No. 579,489 Ser. No. 639,200 filed Aug. 9, 1984 by Harold Brickman for "Foldable Table", both owned by the same entity as is this application, there is shown various embodiments of foldable bar tables. Both of the above identified applications make reference to U.S. Pat. Nos. 4,122,780, 4,177,738 and Des. 252,659.

This application discloses another embodiment of foldable tables utilizing means providing lightweight, yet sturdy, receptacles for holding articles intended for beverage consumption and storage of such articles.

BRIEF SUMMARY OF THE INVENTION

The objectives of this invention are achieved by providing foldable tables wherein a flexible panel is secured to a pair of pivotable legs and provided with openings to receive bar articles. Containers for accomodating articles used for beverage consumption, such as bottles and an ice bucket are provided by means of lightweight metal or plastic open-sided receptacles. The dimensions of the receptacles are such that when the articles are held in the table and the table is opened, the articles are available for ready use, and when the table is folded, the articles may remain in the receptacles for storage purposes.

BRIEF DESCRIPTION OF THE DRAWINGS

The invention itself is set forth in the claims appended hereto and forming a part of this specification, while an understanding of an embodiment thereof may be made by reference to the detailed description and drawings in which:

DETAILED DESCRIPTION

Figure 1:
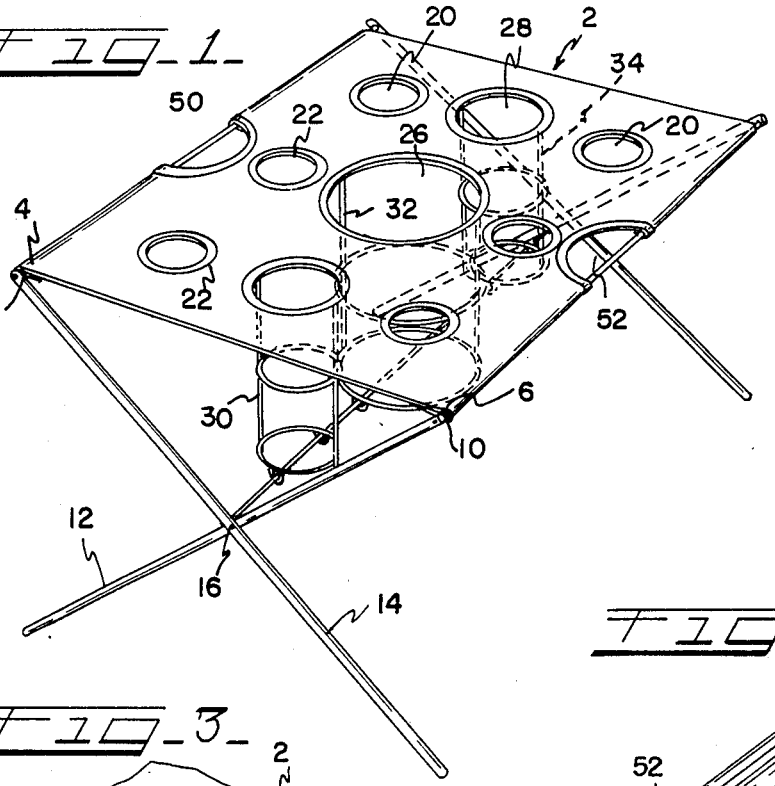
FIG. 1 is a perspective illustration of an embodiment of the invention showing it in the in-use or open position.
Figure 3:
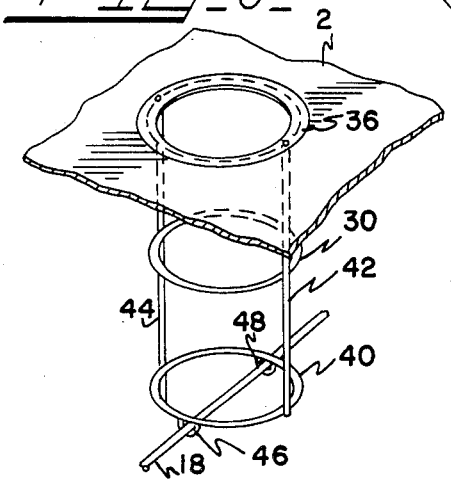
FIG. 3 is a fragmentary illustration of how an article holder may be attached to a table panel.

Referring to FIGS. 1 and 3, the foldable table comprises a table panel 2 formed from a flexible material, such as canvas or plastic, formed in a generally rectangular shape. The table is provided with a pair of loops 4 and 6 at opposite ends. Passing through the loops are normally horizontally extending cross bars 8 and 10. The cross bars 8 and 10 comprise the bight portion of a pair of generally U-shaped legs 12 and 14. The legs 12 and 14 are pivoted together at 16 on each end of the table and are connected by a rod 18 at the pivots. The upper surface of the table panel 2 is provided with a plurality of openings 20 which are dimensioned to receive glasses or drinking containers. The glasses or drinking containers may be inserted into the openings and it is contemplated that they would have sloping sides so that they would not pass entirely through the openings, but rather would have their upper portions extending above the surface of the table, whereby they may be lifted out of the openings and used. The openings 20 may be encompassed by stiffening rings 22 formed of plastic or other suitable material.

Located in the center of the table are a plurality of larger openings 24, 26 and 28. The openings 24 and 28 may be dimensioned to accomodate beverage containers, such as bottles. The opening 26 may be dimensioned to accomodate an ice bucket or other materials. Obviously the dimensions and the number and locations of the openings may be varied as desired by a designer.

Figure 2:
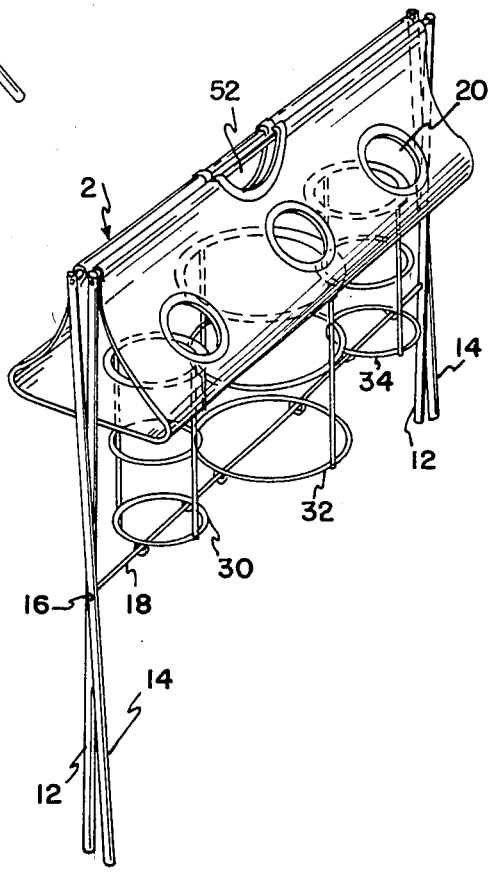
FIG. 2 is a perspective illustration of one of the article holding containers illustrating how it may be attached to the table.

Extending below the upper surface of the table panels and generally coextensive with the openings 24, 26 and 28, are article holding receptacles or containers 30, 32 and 34. As may be seen in FIG. 2, each container is formed as a generally open structure consisting of an upper ring 36, a middle ring 38 and a bottom ring 40. The rings are connected by vertically extending pieces 42 and 44. The rings and the supporting pieces may be formed of either metal or plastic and joined to each other by molding in the case of plastic, or by an adhesive for that matter, and by any suitable means, such as welding or adhesive in the event that metal is used. The upper ring may be joined to the flexible table panel by adhesive or any other suitable means. Attached to the bottom ring 40 in each case are a pair of U-shaped members 46 and 48 encompassing the rod 18. The U-shaped members 46 and 48 are dimensioned to permit relative movement between the rod and the container. Alternatively, the containers could be rigidly attached to the rod 18, again by any suitable means.

The particular construction of the open article containers shown is for purposes of illustration only, as obviously the number of rings can be varied as can the number of vertical supporting members. In addition, if there is a concern about rigidity, then circular or semicircular inclined members can be provided between the supporting members.

Another way in which the containers can be attached to the table panel is to provide two rings at the top of each container as shown in FIG. 3 and the table panel attached between an upper ring **36*a* and a lower ring 36*b***, so that the two rings will clamp the edge of the table panel encompassing the opening therebetween.

Figure 4:
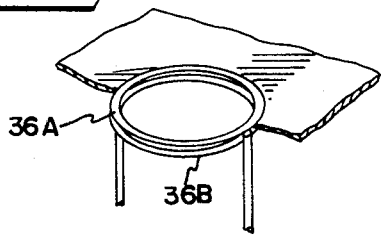
FIG. 4 is a perspective illustration of the embodiment in FIG. 1 showing it in the folded or closed position.

FIG. 1, as stated, illustrates the table in its open position. FIG. 4 illustrates the table in its closed position when the legs 12 and 14 are pivoted about the pivot point 16, bringing the outer edges of the panels together at a point spaced above the upper surface of the panel, so that room is provided to accomodate the upper ends of bottles or other bar articles held in the containers. In this manner, the table may be folded and easily transported to a storage area until its use is desired again. When the table is opened, the articles stored in the containers will be readily available for use.

Cutaway portions 50 and 52 are provided on opposite sides of the table exposing portions of the cross pieces 8 and 10, thereby providing a handle for easy grasping and movement of the table when folded.

Beyond those proposals made above for various modifications in the illustrated embodiment, other changes may be made by a designer for aesthetic or ease in manufacturing purposes while still coming within the scope of the claims appended hereto.

What is desired to be claimed and secured by Letters Patent is:

1. In a foldable table comprising a flexible table panel having a plurality of openings therein to accomodate articles for beverage consumption, a pair of legs having portions engaging opposite ends of said table panel and pivoted intermediate their lengths whereby they may spread apart to open the table for use or be brought together to permit storage and transporting the table for use, the improvement comprising open beverage consumption article holders extending downwardly from some of said openings, and a rod extending from one of the leg pivot points to another attached to the bottoms of said article holders.

2. In the foldable table of claim 1 wherein said article holders comprise a plurality of circular members spaced from each other and connected by vertical members extending between the circular members.

3. In the foldable table of claim 1 or 2 wherein said article holders extend below openings disposed in approximately the center of the flexible table panel.

4. In the foldable table of claim 1 or 2 wherein said article holders are formed of rings of metal or plastic material and are connected to each other by vertically extending members of the same material.

5. In the foldable table of claim 1 or 2 wherein the attachment of said article holders to said rod permits relative movement of said rod and said article holders.

* * * * *